US007559809B2

(12) United States Patent
Takahashi et al.

(10) Patent No.: US 7,559,809 B2
(45) Date of Patent: Jul. 14, 2009

(54) CONNECTOR TERMINAL HOLDING STRUCTURE

(75) Inventors: Masashi Takahashi, Miyagi-ken (JP); Yasuo Tsuchida, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 12/168,404

(22) Filed: Jul. 7, 2008

(65) Prior Publication Data

US 2009/0035999 A1 Feb. 5, 2009

(30) Foreign Application Priority Data

Aug. 2, 2007 (JP) ..... 2007-202249

(51) Int. Cl.
*H01R 13/42* (2006.01)

(52) U.S. Cl. ..... 439/751; 439/733.1; 439/948

(58) Field of Classification Search ..... 439/84, 439/733.1, 751, 873, 891, 943, 948
See application file for complete search history.

(56) References Cited

U.S. PATENT DOCUMENTS 6,997,756 B2 * 2/2006 Nakamura ..... 439/751
7,021,975 B2 * 4/2006 Lappohn ..... 439/733.1
7,025,639 B2 * 4/2006 Aoki et al. ..... 439/751
7,037,146 B2 * 5/2006 Nakamura ..... 439/751

FOREIGN PATENT DOCUMENTS

JP 08-162189 6/1996

* cited by examiner

*Primary Examiner*—Khiem Nguyen
(74) *Attorney, Agent, or Firm*—Brinks Hofer Gilson & Lione

(57) ABSTRACT

A connector terminal holding structure which holds a metallic connector terminal press-fitted into a resin case is provided. The connector terminal includes a terminal contact portion that has such a width as not to come in contact with a discharge hole of a through-groove provided in the resin case, a press-fitted width portion that is connected to the terminal contact portion and has such a width as to be press-fitted into the inner wall of the discharge hole, and an insertion position determination portion that determines an insertion position of the connector terminal. The connector terminal is inserted into the through-groove from the terminal contact portion so as to be exposed from the discharge hole, the insertion position of the connector terminal is determined by the insertion position determination portion, and only the vicinity of a leading end portion of the press-fitted width portion is press-fitted into and held by the inner wall of the discharge hole.

8 Claims, 5 Drawing Sheets

CONNECTOR TERMINAL HOLDING STRUCTURE

CROSS REFERENCE TO RELATED APPLICATIONS

The present application contains subject matter related to Japanese Patent Application JP2007-202249 filed in the Japanese Patent Office on Aug. 02, 2007, the entire contents of which being incorporated herein by reference.

BACKGROUND

1. Field of the Invention

The invention relates to a connector terminal holding structure, and more specifically, a connector terminal holding structure which holds a metallic connector terminal press-fitted into a case formed of a resin material.

2. Description of the Related Art

In the related art, a press-fitting apparatus is proposed, which prevents the occurrence of an electric short-circuit accident caused by metal burrs occurring when a plate-shaped connector terminal is press-fitted into a housing hole of a glass-fiber-filled base material (for example, refer to Japanese Patent Application JP8-162189). In the press-fitting apparatus, projecting portions with a lager width than the connector terminal are provided on the front and rear sides of the press-fitted portion of the connector terminal such that, when being press-fitted into the base material, the connector terminal does not come in contact with a wall portion of the housing hole, and the projecting portions are forcibly brought into contact with the wall portion. Accordingly, the dimension of metal burrs occurring when the connector terminal is press-fitted into the base material can be reduced, which makes it possible to prevent the occurrence of an electric short-circuit accident between the adjacent connector terminals.

In the above-described related-art press-fitting apparatus, however, since the projecting portions provided in the press-fitted portion of the connector terminal is forcibly contacted with the wall portion of the housing hole, the connector terminal press-fitted into the base material may be tilted. Further, the projecting portions provided in the press-fitted portion may inhibit the connector terminal from being press-fitted into the base material. In this case, the connecter terminal may not reach a proper position within the base material, and a portion of the connector terminal exposed from the base material may deviate.

SUMMARY

According to an aspect of the invention, there is provided a connector terminal holding structure which holds a metallic connector terminal press-fitted into a resin case. The connector terminal includes a terminal contact portion that has such a width as not to come in contact with a discharge hole of a through-groove provided in the resin case. A press-fitted width portion is connected to the terminal contact portion and has such a width as to be press-fitted into the inner wall of the discharge hole. An insertion position determination portion determines an insertion position of the connector terminal. The connector terminal is inserted into the through-groove from the terminal contact portion so as to be exposed from the discharge hole, the insertion position of the connector terminal is determined by the insertion position determination portion, and only the vicinity of a leading end portion of the press-fitted width portion is press-fitted into and held by the inner wall of the discharge hole.

DESCRIPTION OF THE EMBODIMENTS

Preferred embodiments of the invention will now be described with reference to the drawings. In the following descriptions, a connector terminal holding structure according to an embodiment of the invention is applied to an EGR (Exhaust Gas Recirculation) sensor, which detects the position of an EGR valve, in an EGR system mounted on a vehicle will be exemplified. However, the connector terminal holding structure according to the embodiment of the invention is not limited thereto, but can be applied to various devices into which connector terminals are assembled.

Figure 1:
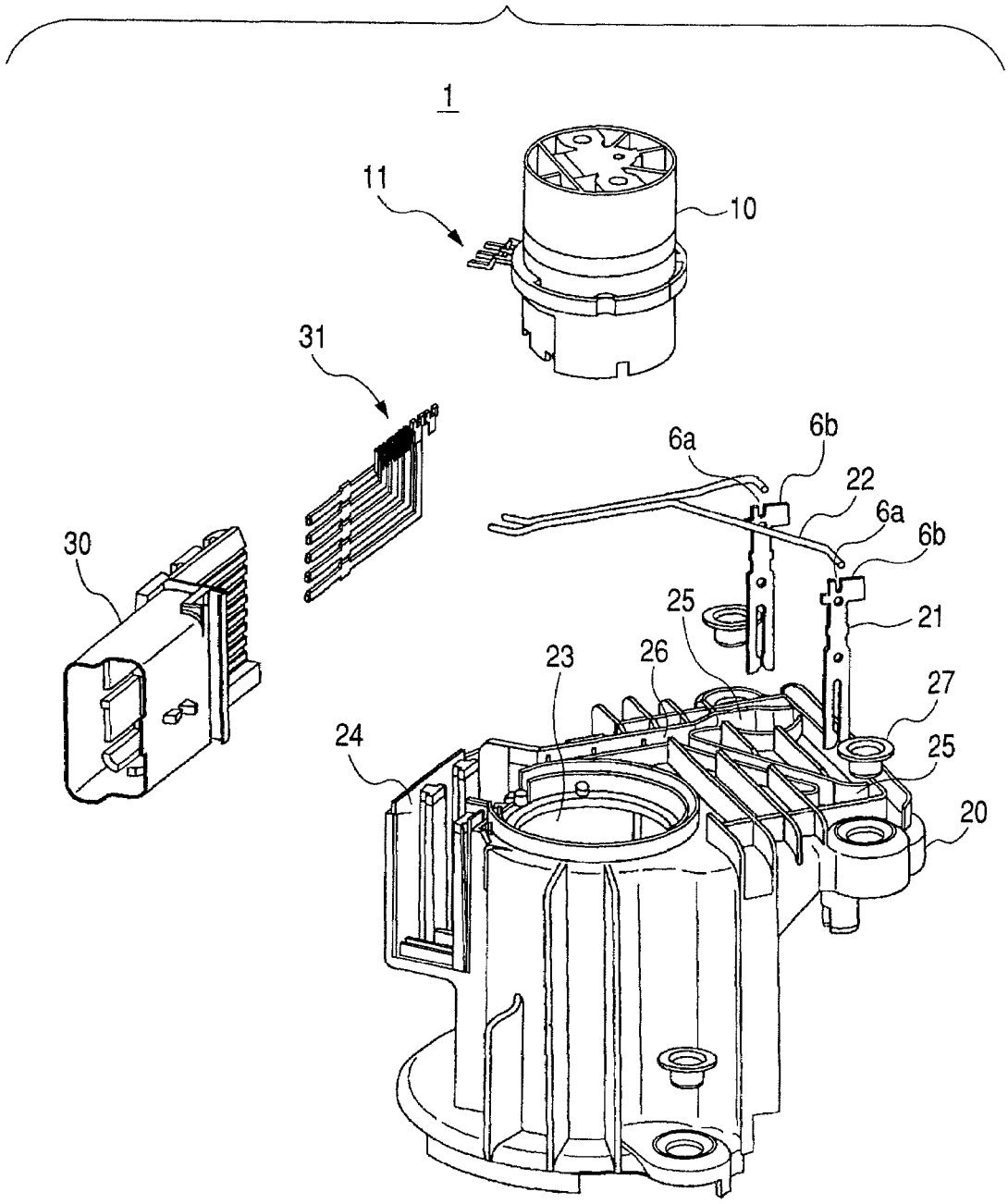
FIG. 1 is an exploded perspective view of an EGR sensor to which a connector terminal holding structure according to an embodiment of the invention is applied.

FIG. 1 is an exploded perspective view of an EGR sensor 1 to which the connector terminal holding structure according to an embodiment of the invention is applied. The EGR sensor 1 shown in FIG. 1 includes a sensor unit 10 which detects the position of an EGR valve, a cover unit 20 which seals a space in which the EGR valve is disposed, and a connector unit 30 to which the connector terminal holding structure according to this embodiment is applied. The EGR sensor 1 is formed by jointing these units such that the units are electrically connected through various terminals which will be described below.

The sensor unit 10 has an operation shaft (not shown) provided on the bottom surface thereof, the operation shaft moving in accordance with the position of the EGR valve. The sensor unit 10 detects the position of the EGR valve through the operation shaft, and outputs an electrical signal according to the position of the EGR valve to a control device which performs various controls within a vehicle. The electrical signal is output to the control device through a terminal (hereinafter, referred to as 'sensor terminal') 11 provided on the side surface of the sensor unit 10 and a connector terminal 31 which will be described below.

The cover unit 20 has a connector housing portion 24 which houses a sensor housing portion 23 and the connector unit 30, the sensor housing portion 23 housing the sensor unit 10. The cover unit 20 is formed in such a shape as to house the EGR valve and a driving motor, which drives the EGR valve, from the lower side. Further, the cover unit 20 has a terminal fixing portion 25, to which a terminal (hereinafter, referred to as 'motor terminal') 21 outputting a driving signal from the control device to the driving motor is attached, and a groove portion 26 to which a terminal connection member 22 for connecting the motor terminal 21 and a terminal (hereinafter, referred to as 'connector terminal') 31 of the connector unit 30 is attached. The cover unit 20 is fixed to a case of an engine through a collar 27 by a screw.

The connector unit 30 connects the EGR sensor to the control device. The EGR sensor is configured in such a manner that an electrical signal from the sensor unit 10 is output to the control device and a driving signal from the control device is output to the driving motor, through the connector unit 30. As shown in FIG. 1, five connector terminals 31 are held by the connector unit 30. Among them, three left-side connector terminals 31 shown in FIG. 1 are connected to the sensor terminal 11, and two right-side connector terminals 31 shown in FIG. 1 are connected to the motor terminal 21 through the terminal connection member 22.

Figure 2A:
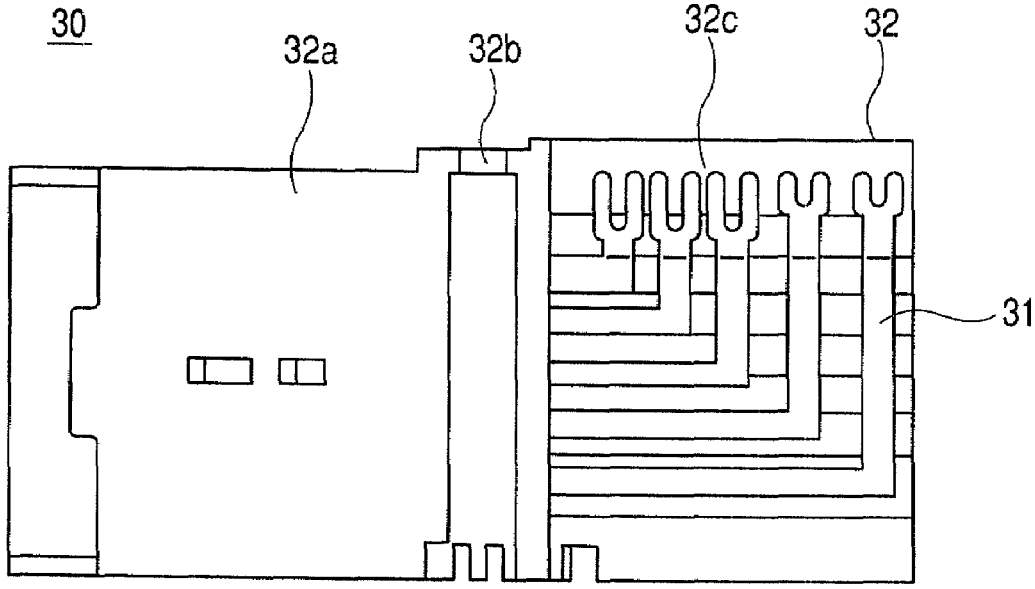
FIGS. 2A and 2B are side and cross-sectional view for explaining the construction of a connector unit according to this embodiment.
Figure 2B:
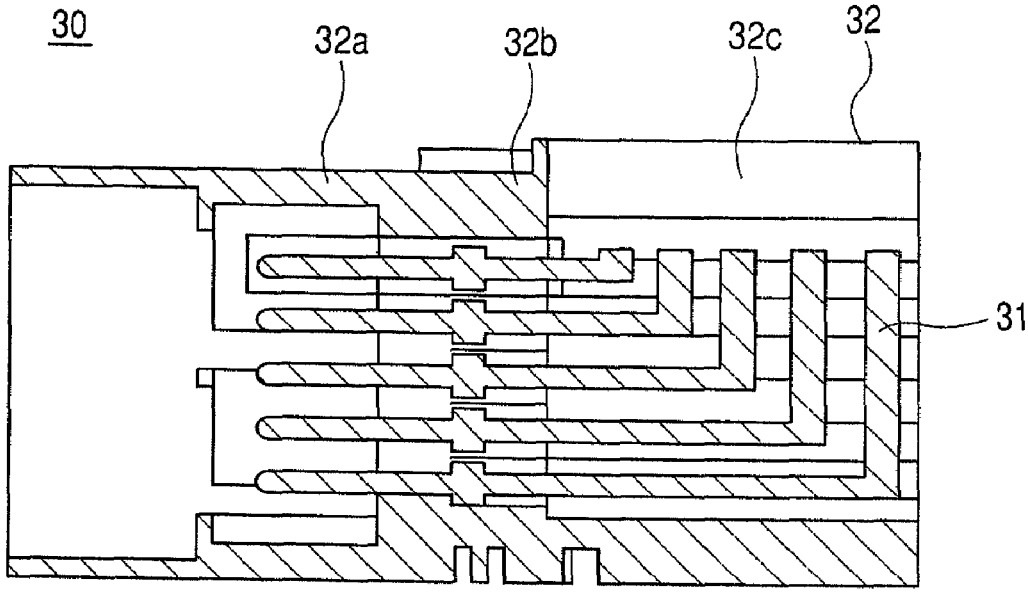

Hereinafter, the construction of the connector unit 30 according to this embodiment will be described. FIGS. 2A and 2B are side and cross-sectional views for explaining the construction of the connector unit 30 according to this embodiment. FIG. 2B shows the cross-section of the connector unit 30 when the connector terminals 31 shown in FIG. 2A are cut in the vertical direction.

As shown in FIGS. 2A and 2B, the connector unit 30 is formed by pressing the connector terminals 31 into a case (hereinafter, referred to as 'resin case') 32 such that the connector terminals 31 are arranged as in FIGS. 2A and 2B, the resin case being formed by molding a resin material in a predetermined shape. The resin case 32 includes a housing portion 32*a* which is opened to the left side in FIGS. 2A and 2B, a wall portion 32*b* having through-grooves through which the connector terminals 31 pass, and a support wall portion 32*c* which supports one surfaces (in the deep side of the paper surface of FIGS. 2A and 2B) of the connector terminals 31.

As shown in FIG. 2A, the connector terminals 31 horizontally extend so as to be bent upward at right-side end portions thereof shown in FIG. 2A such that the upper end portions thereof can hold the sensor terminal 11 and the terminal connection member 22. Further, as shown in FIG. 2B, portions of the connector terminals 31 extending to the left side are inserted into the through-grooves formed in the wall portion 32*b* so as to be held by the wall portion 32*b* in a state where the positions of the leading end portions thereof are aligned. In this case, the connector terminals 31 can be electrically connected to an object connected to the connector unit 30 in a state where portions of the connector terminals 31 are exposed to the housing portion 32*a*.

Figure 3:
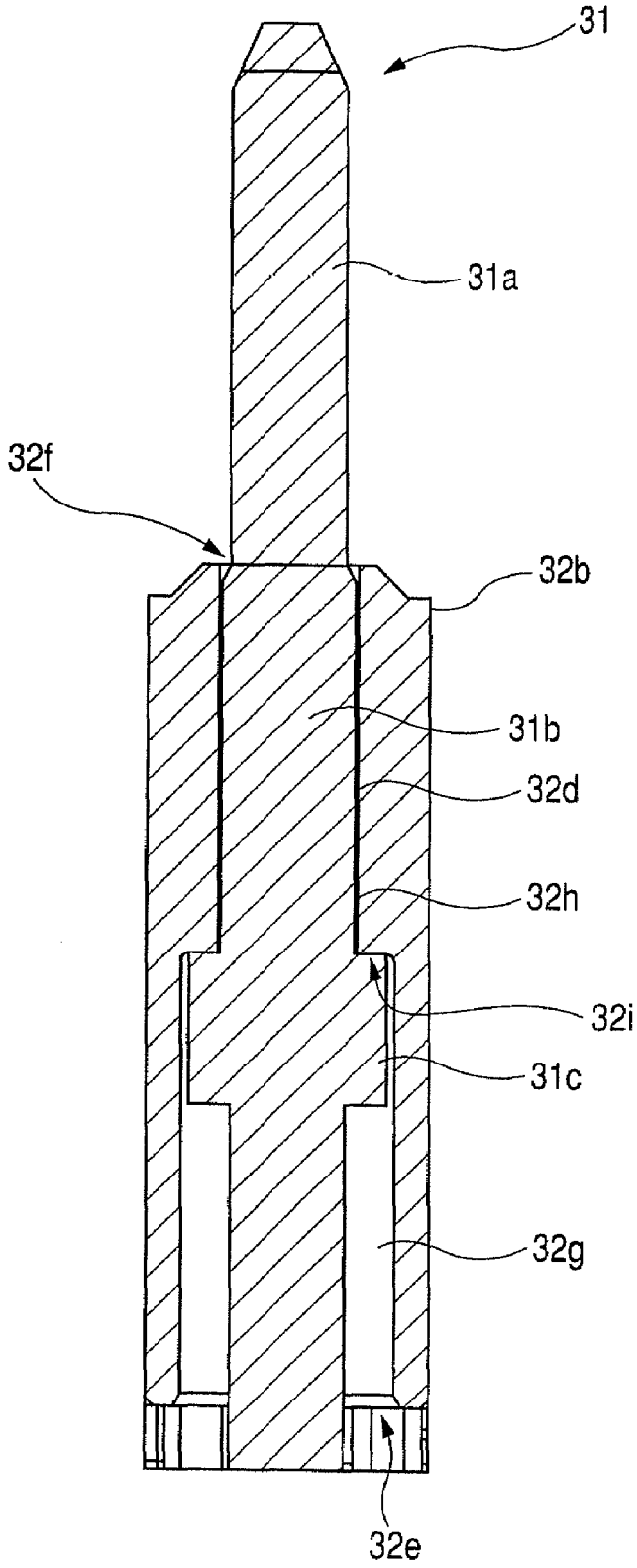
FIG. 3 is an enlarged view for explaining the relationship between connector terminals of the connector unit and a resin case according to this embodiment.

Hereinafter, the relationship between the connector terminals 31 and the resin case 32 will be described with reference to FIG. 3. FIG. 3 is an enlarged view for explaining the relationship between the connector terminals 31 of the connector unit 30 and the resin case 32 according to this embodiment. FIG. 3 shows a single connector terminal 31 held by the resin case 32. For convenience of description, the left-side leading end portion of the connector terminal 31 shown in FIG. 2B is illustrated so as to be directed to the upper side in FIG. 3.

The connector terminal 31 is formed of a plate-shaped member and has a terminal contact portion 31*a* extending to the upper side in FIG. 3, a press-fitted width portion 31*b* connected to the lower side of the terminal contact portion 31*a*, and an insertion position determination portion 31*c* connected to the lower side of the press-fitted width portion 31*b*. The thickness of the terminal contact portion 31*a* is set to be smaller than those of the press-fitted width portion 31*b* and the insertion position determination portion 31*c*. For example, as a crushing process is performed on only the terminal contact portion 31*a*, the terminal contact portion 31*a* is processed so as to have a smaller thickness than the press-fitted width portion 31*b* and the insertion position determination portion 31*c*. The thickness of the terminal contact portion 31*a* is set to be slightly smaller than that of a discharge hole 32*f* which will be described below, and the thickness of the press-fitted width portion 31*b* is set to be slightly larger than that of the discharge hole 32*f*.

In the connector terminal 31, the terminal contact portion 31*a* has a slightly smaller width than the inner wall of the discharge hole 32*f* so as not to come in contact with the inner wall. The press-fitted width portion 31*b* has a slightly larger width than the inner wall of the discharge hole 32*f* so as to be press-fitted into the inner wall. The insertion position determination portion 31*c* has a larger width than the press-fitted width portion 31*b* so as to abut on an abutting portion 32*i* within a wall portion 32*b* which will be described below. As the insertion position determination portion 31*c* abuts on the abutting portion 32*i*, the insertion amount of the connector terminal 31 is restricted in such a manner that the position of the connector terminal 31 is determined. Therefore, it is possible to determine the insertion position of the connector terminal 31 through the simple and inexpensive structure.

The wall portion 32*b* of the resin case 32 has a through-groove 32*d* through which the connector terminal 31 is inserted. The through-groove 32*d* has a slightly larger thickness than the press-fitted width portion 31*b* of the connector terminal 31. That is, the through-groove 32*d* is constructed to house a lower portion of the connector terminal 31 from the press-fitted width portion 31*b*, with a slight clearance set therebetween. Further, the vicinity of the discharge hole 32*f* has a slightly smaller thickness than the press-fitted width portion 31*b* and a slightly larger thickness than the terminal contact portion 31*a*.

The width of the through-groove 32*d* decreases in a stepwise manner from an insertion hole 32*e* to the discharge hole 33*f*. Specifically, the through-groove 32*d* has a large width portion 32*g* provided in the upper side of the insertion hole 32*e* shown in FIG. 3 and a small width portion 32*h* provided in the upper side of the large width portion 32*g*. The large width portion 32*g* has a larger width than the insertion position determination portion 31*c* of the connector terminal 31, and the small width portion 32*h* has a slightly larger width than the press-fitted width portion 31*b*. Further, between the large width portion 32*g* and the small width portion 32*h*, the abutting portion 32*i* is provided, on which the insertion position determination portion 31*c* abuts.

The small width portion 32*h* is constructed in such a manner that the width thereof in the vicinity of the inner wall of the discharge hole 32*f* is slightly reduced. In particular, the width of the inner wall of the discharge hole 32*f* is set to be slightly smaller than that of the press-fitted width portion 31*b* and is set to be slightly larger than that of the terminal contact portion 31*a*.

Into the resin case 32 constructed in such a manner, the connector terminal 31 is inserted, with the terminal contact portion 31*a* being headed. When the connector terminal 31 reaches the discharge hole 32*f* through the through-groove 32*d*, the terminal contact portion 31*a* passes without coming in contact with the discharge hole 32*f*, because the terminal contact portion 31*a* is thinner in the thickness direction and narrower in the width direction than the inner wall of the discharge hole 32*f*. On the other hand, the press-fitted width portion 31*b* is press-fitted into the inner wall of the discharge hole 32*f*, because the press-fitted width portion 31*b* is slightly thicker in the thickness direction and slightly wider in the width direction than the inner wall of the discharge hole 32*f*. In particular, the connector terminal 31 is press-fitted into the inner wall of the discharge hole 32*f* at the connection portion between the terminal contact portion 31*a* and the press-fitted width portion 31*b*.

Figure 4:
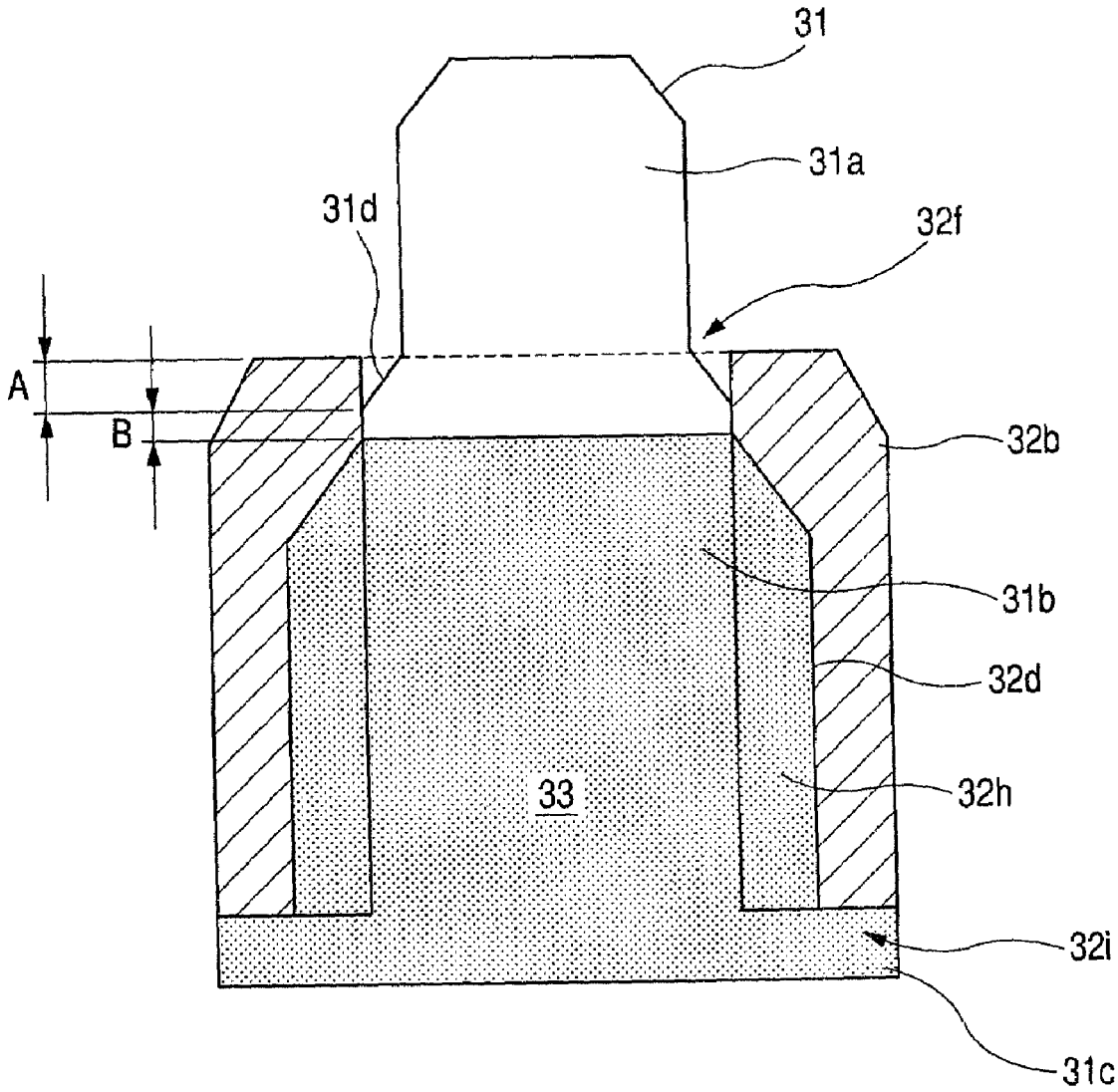
FIG. 4 is a schematic view for explaining the state of the vicinities of a discharge hole formed in a wall portion of the resin case of the connector unit according to this embodiment.

In this case, the state of the vicinities of the discharge hole 32*f* into which the press-fitted width portion 31*b* is press-fitted will be described with reference to FIG. 4. FIG. 4 is a schematic view for explaining the state of the vicinities of the discharge hole 32*f* formed in the wall portion 32*b* of the resin case 32.

As shown in FIG. 4, the terminal contact portion 31*a* has such a width as not to come in contact with the discharge hole 32*f*, and the press-fitted width portion 31*b* has such a width as to be press-fitted into the discharge hole 32*f*. Further, between the terminal contact portion 31*a* and the press-fitted width portion 31*b*, a tapered portion 31*d* is formed, as shown in FIG. 4. When the connector terminal 31 is inserted into the through-groove 32*d*, as shown in FIG. 4, the insertion position determination portion 31*c* abuts on the abutting portion 32*i* at a position where the press-fitted width portion 31*b* formed in the lower side of the tapered portion 31*d* is press-fitted into the inner wall of the discharge hole 32*f*. Accordingly, the press-fitted width portion 31*b* is press-fitted into the inner wall of the discharge hole 32*f* at an inner (lower) position from the discharge hole 32*f*. Further, the length B of the portion press-fitted into the inner wall of the discharge hole 32*f* is smaller than the length A of a portion from the upper end portion of the press-fitted portion to the discharge hole 32*f*, as shown in FIG. 4. Therefore, metal burrs which may occur when the connector terminal 31 is inserted are prevented from coming out of the discharge hole 32*f*.

In the holding structure of the connector terminal 31 according to this embodiment, an adhesive 33 is poured into the through-groove 32*d* from the insertion hole 32*e* in a state where the connector terminal 31 is press-fitted into the resin case 32. The adhesive 33 is poured up to the large width portion 32*g* and the small width portion 32*h* of the wall portion 32*b*. As the adhesive 33 poured in such a manner solidifies, the connector terminal 31 is fixed to the resin case 32, and the through-groove 32*d* is sealed. Accordingly, a portion of the connector terminal 31, which is not press-fitted into the discharge hole 32*f* but is disposed within the resin case 32, is fixed. Therefore, it is possible to reliably hold the connector terminal 31 in the resin case.

In the holding structure of the connector terminal 31 according to this embodiment, the terminal contact portion 31*a* is set to have such a width as not to come in contact with the discharge hole 32*f* of the through-groove 32*d* provided in the resin case 32, and the press-fitted width portion 31*b* is set to have such a width as to be press-fitted into the inner wall of the discharge hole 32*f*. Further, only the vicinity of the leading end portion of the press-fitted width portion 31*b* is press-fitted into the inner wall of the discharge hole 32*f* such that the connector terminal 31 is held. Therefore, when the connector terminal 31 is inserted, metal burrs are prevented from occurring. Further, even when metal burrs occur, the dimension thereof can be reduced. Accordingly, it is possible to prevent the occurrence of an electric short-circuit accident between the adjacent connector terminals 31. Further, since the insertion position determination portion 31*c* which determines the insertion position of the connector terminal 31 is provided in the connector terminal 31, the insertion position of the connector terminal 31 can be prevented from deviating. Therefore, it is possible to dispose the press-fitted connector terminal 31 in a proper position.

In the holding structure of the connector terminal 31 according to this embodiment, only the vicinity of the discharge hole 32*f* of the resin case 32 is set to have a slightly smaller width than the press-fitted width portion 31*b*. Accordingly, the portion of the connector terminal 31 press-fitted into the discharge hole 32*f* in the resin case 32 can be reduced in size. Therefore, it is possible to reduce a probability that metal burrs occur when the connector terminal 31 is inserted. Further, even when metal burrs occur, the dimension of the metal burrs can be further reduced.

In the holding structure of the connector terminal 31 according to this embodiment, the connector terminal 31 is formed of a plate-shaped member. Further, the terminal contact portion 31*a* is set to have such a thickness as not to come in contact with the discharge hole 32*f*, and the press-fitted width portion 31*b* is set to have such a thickness as to be press-fitted into the inner wall of the discharge hole 32*f*. Therefore, it is possible to further reduce a probability that metal burrs occur when the connector terminal 31 is inserted.

The invention is not limited to the above-described embodiment, but various modifications can be made. In the above-described embodiment, the size and shape of the components illustrated in the accompanying drawings are not limited thereto, but can be properly changed in such a range where the effect of the invention is exhibited. In addition, various changes and modifications in form and detail may be made therein without departing from the scope of the invention.

In the above-described embodiment, it has been described that the crushing process is performed on the terminal contact portion 31*a* of the connector terminal 31 such that the thickness of the terminal contact portion 31*a* is set to be smaller than that of the press-fitted width portion 31*b*. However, the method of making the terminal contact portion 31*a* thinner than the press-fitted width portion 31*b* is not limited thereto, but can be properly modified. For example, as a plating thickness is adjusted by performing a plating process on the connecter terminal 31, the thickness of the terminal contact portion 31*a* may be set to be smaller than that of the press-fitted width portion 31*b*.

Figure 5:
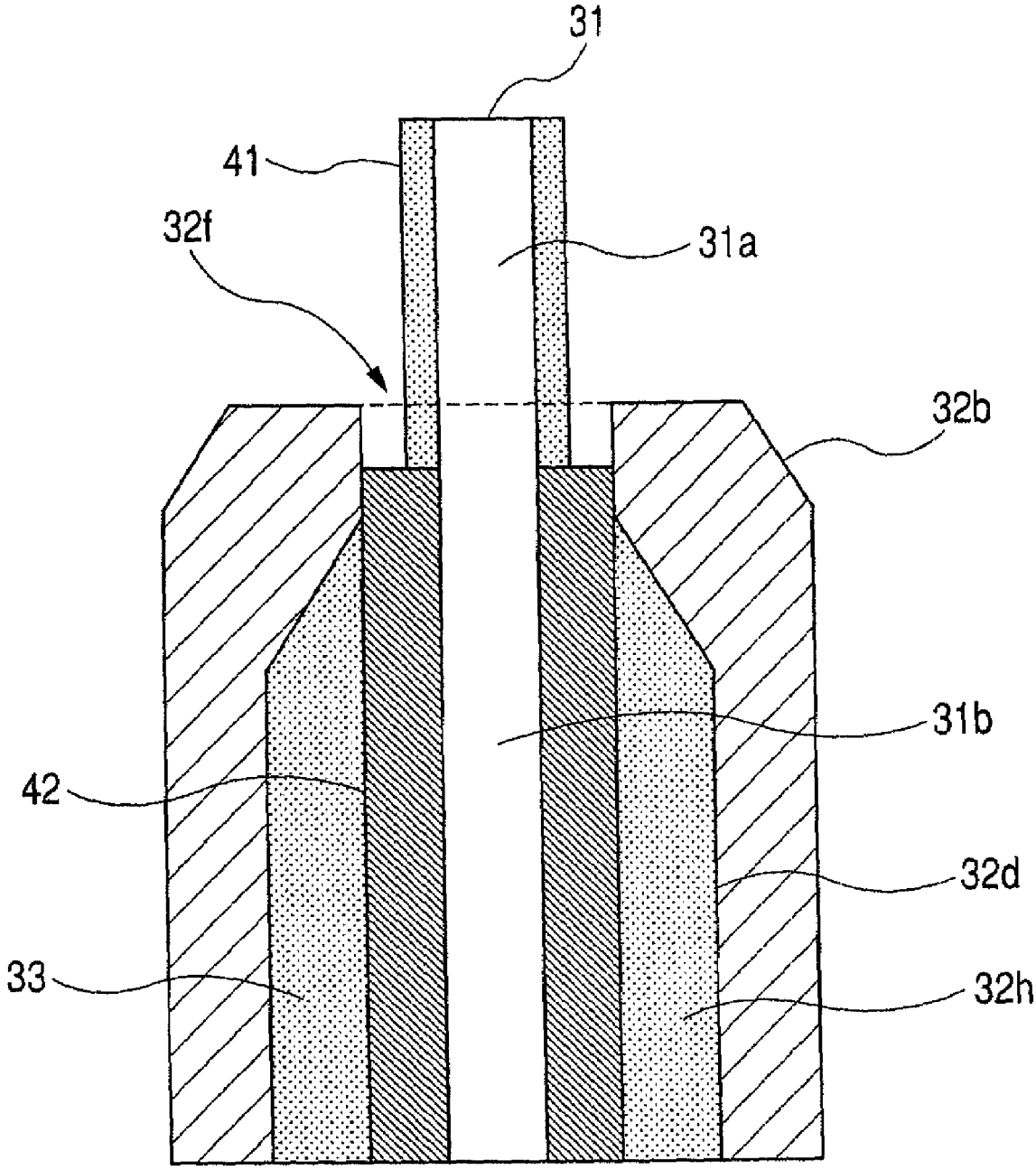
FIG. 5 is a schematic view for explaining the state of the vicinities of the discharge hole formed in the wall portion of the resin case of the connector unit according to this embodiment.

FIG. 5 is a schematic enlarged view of the vicinities of the discharge hole 32*f* when the thickness of the terminal contact portion 31*a* is set to be smaller than that of the press-fitted width portion 31*b* by the plating process. FIG. 5 shows the cross-section of the connector terminal 31 when the connector terminal 31 shown in FIG. 2A is horizontally cut.

In this case, as shown in FIG. 5, plating 41 is applied to the terminal contact portion 31*a* of the connecter terminal 31 such that the thickness of the terminal contact portion 31*a* after the plating process is set to be smaller than that of the inner wall of the discharge hole 32*f*. Meanwhile, plating 42 is applied to the press-fitted width portion 31*b* such that the thickness of the press-fitted width portion 31*b* after the plating process is set to be slightly larger than that of the inner wall of the discharge hole 32*f*. Accordingly, the terminal contact portion 31*a* passes without coming in contact with the inner wall of the discharge hole 32*f*, and the press-fitted width portion 31*b* has such a thickness as to be press-fitted into the inner wall of the discharge hole 32*f*.

When the thickness of the connector terminal 31 is adjusted by the plating process, it is possible to reduce a cost and time required for the crushing process which is performed on the terminal contact portion 31*a*. In particular, when the plating process is performed on the connector terminal 31 so as to adjust the thickness, it is preferable that metal plating (for example, silver or gold) is applied, which is softer than the plating for a base material terminal or the terminal contact portion 31*a*. When the metal plating is adopted, it is possible to reduce stress which is to be applied to the resin case 32, thereby preventing cracks from occurring.

The method of adjusting the dimension of the connector terminal 31 using the plating method can be also applied to a case where a difference in width between the contact terminal portion 31*a* and the press-fitted width portion 31*b* is provided as in the above-described embodiment. In this case, since the contact terminal portion 31*a* and the press-fitted width portion 31*b* of the connector terminal 31 do not need to be formed in a specific shape, it is possible to reduce a cost and time required for manufacturing the connector terminal 31.

In the above-described embodiment, it has been described that the width of the terminal contact portion 31*a* is set to be smaller than that of the press-fitted width portion 31*b*, and the thickness of the terminal contact portion 31*a* is set to be smaller than that of the press-fitted width portion 31*b*. The construction of the connector terminal 31 is not limited thereto, but can be properly modified. For example, only any one of the width and thickness of the connector terminal 31 may be set as in the above-described embodiment. That is, the thicknesses of the terminal contact portion 31*a* and the press-fitted width portion 31*b* may be equalized, and the width of the terminal contact portion 31*a* may be set to be smaller than that of the press-fitted width portion 31*b*. Similarly, the widths of the terminal contact portion 31*a* and the press-fitted width portion 31*b* may be equalized, and the thickness of the terminal contact portion 31*a* may be set to be smaller than that of the press-fitted width portion 31*b*. Even when the connector terminal 31 is constructed in such a manner, it is possible to obtain a similar effect to the above-described embodiment, even though there is a slight difference in effect.

According to the embodiment of the invention, the terminal contact portion is set to have such a width as not to come in contact with the discharge hole of the through-groove provided in the resin case, and the press-fitted width portion is set to have such a width as to be press-fitted into the inner wall of the discharge hole. Therefore, it is possible to prevent metal burrs from occurring when the connector terminal is inserted. Further, even when metal burrs occur, the dimension thereof can be reduced. Accordingly, it is possible to prevent the occurrence of an electric short-circuit accident between the adjacent connector terminals. Further, since the insertion position determination portion which determines the insertion position of the connector terminal is provided in the connector terminal, it is possible to prevent the insertion position of the connector terminal from deviating. Therefore, it is possible to dispose the press-fitted connector terminal in a proper position.

It should be understood by those skilled in the art that various modifications, combinations, sub-combinations and alternations may occur depending on design requirements and other factors insofar as they are within the scope of the appended claims of the equivalents thereof.

The invention claimed is:

1. A connector terminal holding structure which holds a metallic connector terminal press-fitted into a resin case, the connector terminal comprising:

a terminal contact portion that has such a width as not to come in contact with a discharge hole of a through-groove provided in the resin case;

a press-fitted width portion that is connected to the terminal contact portion and has such a width as to be press-fitted into the inner wall of the discharge hole; and an insertion position determination portion that determines an insertion position of the connector terminal, wherein the connector terminal is inserted into the through-groove from the terminal contact portion so as to be exposed from the discharge hole, the insertion position of the connector terminal is determined by the insertion position determination portion, and only the vicinity of a leading end portion of the press-fitted width portion is press-fitted into and held by the inner wall of the discharge hole.

2. The connector terminal holding structure according to claim 1, wherein only the vicinity of the discharge hole of the resin case is set to have a slightly smaller width than the press-fitted width portion.

3. The connector terminal holding structure according to claim 1, wherein the insertion position determination portion has a larger width than the press-fitted width portion and has such a width as to abut on the inner wall within the through-groove.

4. The connector terminal holding structure according to claim 1, wherein a portion of the connector terminal, which is disposed within the resin case, is fixed through an adhesive.

5. The connector terminal holding structure according to claim 1, wherein the connector terminal is constructed of a plated member, the terminal contact portion is set to have such a thickness as not to come in contact with the discharge hole, and the press-fitted width portion is set to have such a thickness as to be press-fitted into the inner wall of the discharge hole.

6. The connector terminal holding structure according to claim 5, wherein the thickness of the press-fitted width portion is set to be larger than that of the terminal contact portion by a plating process performed on the connector terminal.

7. A connector terminal holding structure which holds a metallic connector terminal press-fitted into a resin case, the connector terminal comprising:

a terminal contact portion that has such a thickness as not to come in contact with a discharge hole of a through-groove provided in the resin case;

a press-fitted thickness portion that is connected to the terminal contact portion and has such a thickness as to be press-fitted into the inner wall of the discharge hole; and an insertion position determination portion that determines an insertion position of the connector terminal, wherein the connector terminal is inserted into the through-groove from the terminal contact portion so as to be exposed from the discharge hole, the insertion position of the connector terminal is determined by the insertion position determination portion, and only the vicinity of a leading end portion of the press-fitted thickness portion is press-fitted into and held by the inner wall of the discharge hole.

8. The connector terminal holding structure according to claim 7, wherein the thickness of the press-fitted thickness portion is set to be larger than that of the terminal contact portion by a plating process performed on the connector terminal.

* * * * *